United States Patent [19]

Stroh

[11] Patent Number: 4,467,989

[45] Date of Patent: Aug. 28, 1984

[54] COLLAPSIBLE RACK FOR PLASTIC BAG

[75] Inventor: Alvin L. Stroh, Downey, Calif.

[73] Assignee: McMillin Wire & Plating, Inc., Los Angeles, Calif.

[21] Appl. No.: 423,217

[22] Filed: Sep. 24, 1982

[51] Int. Cl.[3] ..... B65B 67/00

[52] U.S. Cl. ..... 248/97; 248/99; 248/153; 248/175

[58] Field of Search ..... 248/95, 97, 98, 99, 248/100, 175, 166, 150, 153, 302, 460; 211/42; 53/390; 141/314, 391; 232/43.2

[56] References Cited

U.S. PATENT DOCUMENTS

| | | | |
|---|---|---|---|
| 470,050 | 3/1892 | Jewell | 211/42 X |
| 1,895,904 | 1/1933 | Lutts et al. | 248/95 X |
| 2,222,089 | 11/1940 | Saffell | 248/175 X |
| 4,332,361 | 6/1982 | McClellan | 248/95 |
| 4,364,534 | 12/1982 | Valesko | 248/97 |

FOREIGN PATENT DOCUMENTS

| | | | |
|---|---|---|---|
| 1100926 | 2/1979 | Canada | 53/390 |
| 598057 | 4/1978 | Switzerland | 248/100 |

*Primary Examiner*—J. Franklin Foss
*Assistant Examiner*—David L. Talbott
*Attorney, Agent, or Firm*—John T. Matlago

[57] ABSTRACT

A collapsible wire rack is disclosed for holding a plastic grocery bag in a suspended position with the mouth of the bag open. The base of the rack is made of two identical halves, each formed of a single length of wire. U-shaped notches for effectively locking the side supports of the rack in an upright position are provided at each corner of the base. Each U-shaped notch comprises two vertically spaced portions respectively forming continuations of the longitudinal portion and the transverse portion of a base half.

8 Claims, 6 Drawing Figures

39
29
39
38
15
14
35
46
22
13
38
33
10
11
25
21
36
47
41
31
34
48
16
37
26
23
27
18
32
17
49
38
20
12
19
24a
28
24b
15
40
40
30

40
30
38
40
15
39
29
37
39
10
14
23
47
34
26
13
36
21
46
24b
49
17
33
25
22
35
12
48
11
28
16
20
24b
6
27
24a
6

51
54
30
53
24a
40
39
52
29
28
37
15
39
55
10
34
14
21
46
24b
33
35
24a
12
13
22
48
28
20
25
16
27
24a
24b

COLLAPSIBLE RACK FOR PLASTIC BAG

BACKGROUND OF THE INVENTION

This invention relates to fixtures and more particularly to a rack for supporting a plastic bag in an open position.

Plastic bags are frequently used in a grocery store in place of paper bags for holding items purchased by a customer. Inasmuch as it has been the practice for a consumer to reuse the paper bags that are brought home from the grocery stores for the disposing of trash, it would be highly desirable to provide a rack that enables the consumer to reuse the plastic grocery bags for this purpose.

The paper bag is made of a sufficiently stiff paper so that it can be made available for reuse as a trash bag by simply inserting it into a conventional container with its upper end open. On the other hand, the plastic bag is made of a thin pliable material that has no stiffness and consequently must be suspended in an upright open position for such use. Inasmuch as a rack for holding a plastic bag is necessarily relatively bulky and cumbersome to handle, it is highly advantageous to make such a rack collapsible so that it can be conveniently stored and transported.

SUMMARY OF THE INVENTION

In a preferred embodiment of the present invention, the rack includes a rectangular base that is formed of wire to comprise transverse portions and longitudinal portions with U-shaped notches at each corner thereof. Each corner U-shaped notch includes a pair of vertically spaced U-shaped wire portions with one of the U-shaped wire portions being formed at one level as a continuation of the transverse portion and the other U-shaped wire portion being formed at another level as a continuation of the longitudinal portion of the base. The rack includes a pair of side supports. Each side support is formed of wire to comprise a pair of spaced elongated arms with a holder portion joining the upper ends thereof and with hooks provided on the lower ends thereof by which the side support is pivotally held on a transverse portion of the base.

When the base is positioned in an upside down position with the U-shaped wire portions forming a continuation of the transverse portions located above the U-shaped wire portions forming a continuation of the longitudinal portions, the elongated arms of the side supports can be swung on the respective transverse portions down into the plane of the base in a collapsed condition.

On the other hand, when the base is turned over into its rightside up position, with the U-shaped wire portions forming a continuation of the transverse portions located below the U-shaped wire portions forming a continuation of the longitudinal portions, the elongated arms of the side supports can be effectively locked by the latter U-shaped wire portions in a substantially upright position. Such an erected structure enables the arm holes on either side of a plastic bag to be hung over the holder portions of the side supports to hold the plastic bag in a suspended position with its mouth in an open position.

Accordingly, one of the objects of the present invention is to provide an inexpensive, collapsible rack that can be readily erected for use in holding a plastic grocery bag in a suspended position with the mouth of the bag open.

Another object of the present invention is to provide a wire rack for use in holding a plastic grocery bag in a suspended position with the mouth of the bag open wherein notches provided on the corners of the base for holding the side supports of the rack in an upright position are integrally formed from portions of the same unitary length of wire used to form the longitudinal and transverse portions of a base half.

With these and other objects in view, the invention consists of the construction, arrangement and combination of the various parts of the device, whereby the objects contemplated are attained, as hereinafter set forth, pointed out in the appended claims and illustrated in the accompanying drawings.

DESCRIPTION OF THE PREFERRED EMBODIMENT

Figure 1:
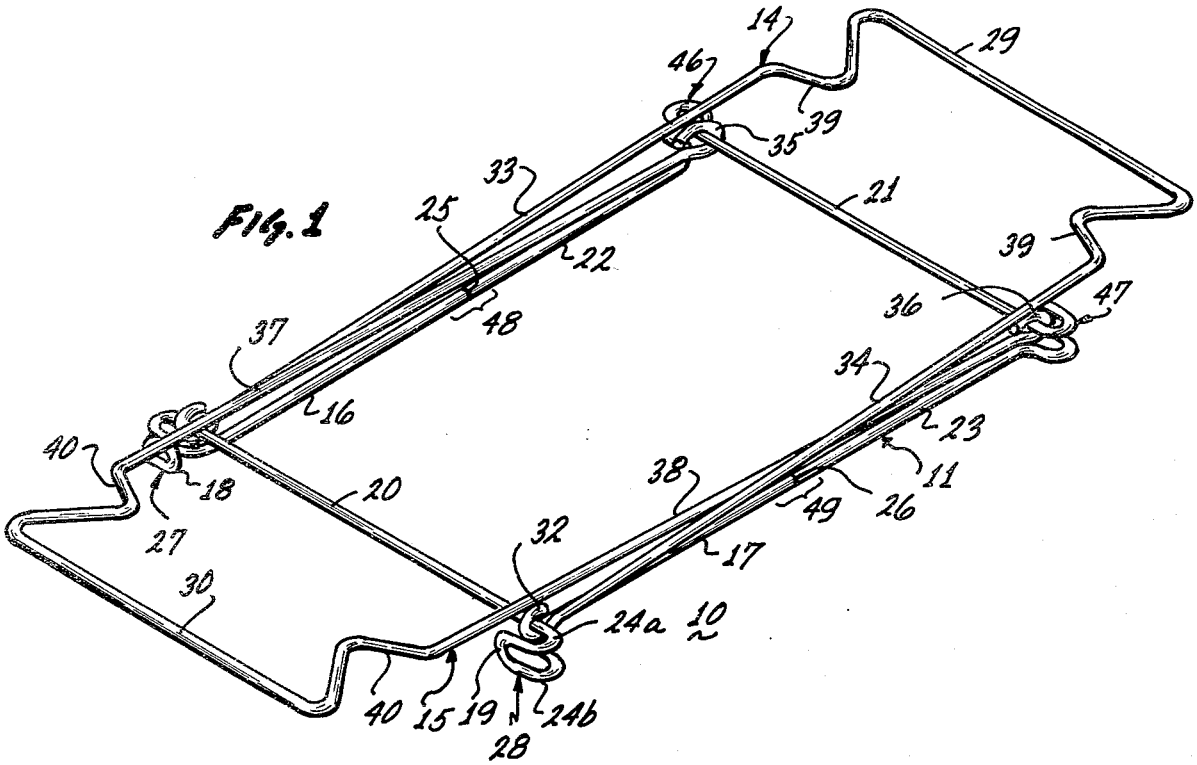
FIG. 1 is a perspective view showing the rack of the present invention in its collapsed condition.

Referring to FIG. 1, the rack 10 of the present invention is shown in a collapsed condition with the side supports 14 and 15 thereof swung down so as to be positioned substantially in the plane of the base 11 which is lying on a horizontal surface in an upside down position.

Figure 2:
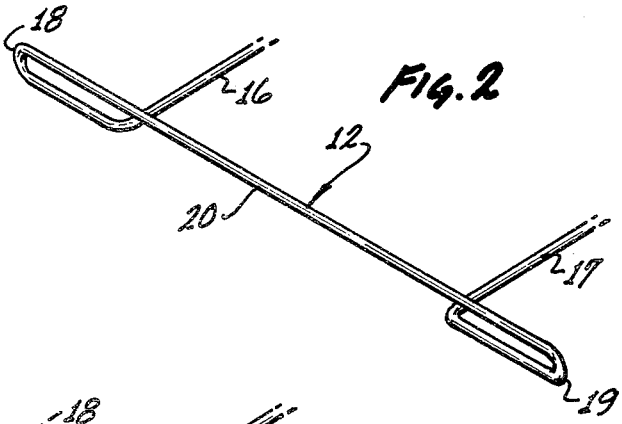
FIG. 2 shows the initial forming of one of the base havles from a single length of wire.
Figure 4:
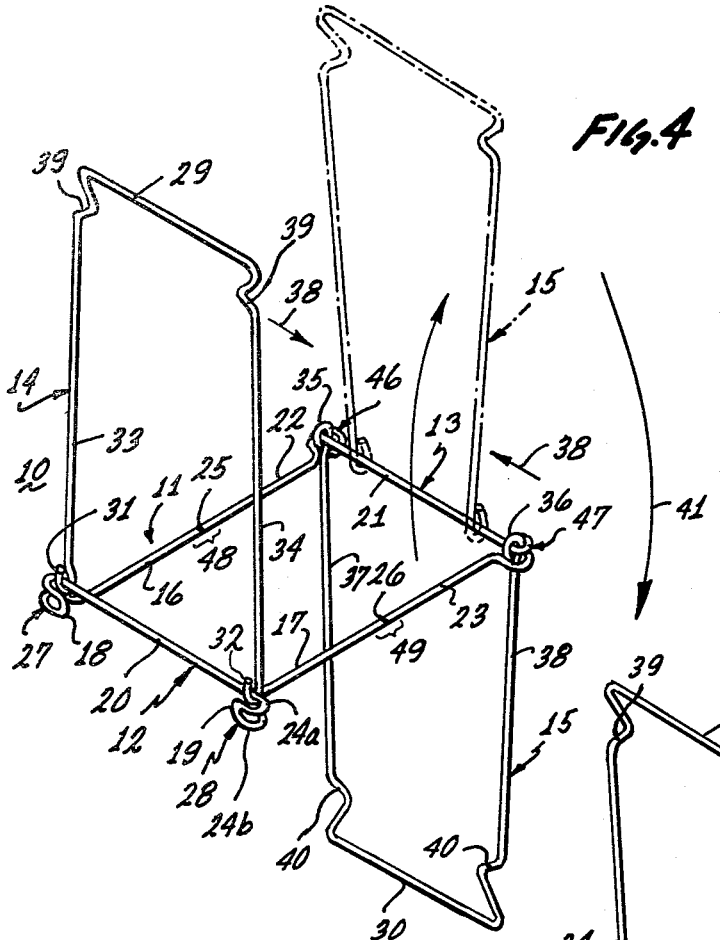
FIG. 4 shows how the side supports of the rack can be manipulated so that they extend downwardly from the base with the hooked ends of their arms effectively locked within the U-shaped notches at the side corners thereof.

As best seen in FIG. 4, the base 11 for the rack 10 is preferably made of two identical halves 12 and 13, each formed of a single length of wire. As shown in FIG. 2, to make base half 12, inward from a straight portion 16 formed on one end of a length of wire, the wire is bent outwardly at a right angle and then back above itself to form a first short laterally extending U-shaped projection 18. The length of wire then forms a straight transverse portion 20 which is disposed at right angles to the straight end portion 61, but at a higher level. The length of wire beyond the end of the transverse portion 20 is then bent back below itself to form a second short laterally extending U-shaped projection 19, and then bent at a right angle to the transverse portion 20 to form a straight portion 17 on the other end of the length of wire. The straight portions 16 and 17 of the length of wire are thus disposed parallel to each other and at right angles to the transverse portion 20.

Figure 3:
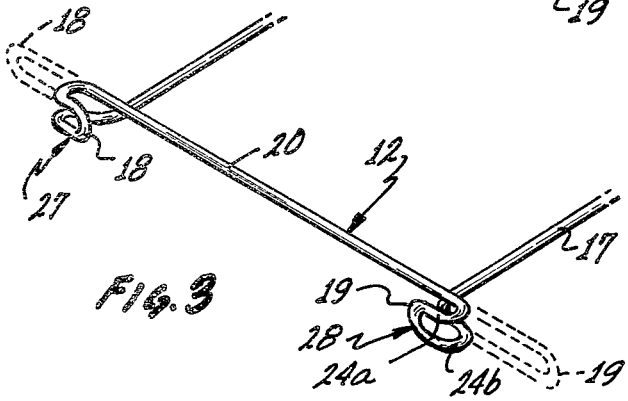
FIG. 3 shows the final forming of the base half to provide U-shaped notches at the corners thereof.

As shown in FIG. 3, each of the laterally extending U-shaped projections 18 and 19 at the corners is bent in an outwardly direction back on itself to form U-shaped notches 27 and 28 at opposite corners of the base half 12.

It should now be clearly understood that each of the U-shaped notches, such as U-shaped notch 28, is formed of two vertically spaced U-shaped wire portions 24*a* and 24*b* with the wire portion 24*a* being a continuation of the straight transverse portion 20 and the other wire portion 24*b* being a continuation of the straight end portion 17 at the corner of the base half.

As seen in FIG. 4, the other half 13 of the base 11 is similarly formed of a single length of wire to provide straight end portions 22 and 23, a transverse portion 21, and U-shaped notches 46 and 47 on the opposite corners of the base half 13.

The two halves 12 and 13 of the base 11 as thus formed then have their straight end portions 16 and 22 welded together at 25 to provide the longitudinal portion 48 of the base and have their straight end portions 17 and 23 welded together at 26 to provide the longitudinal portion 49 of the base.

The side support 14 of the rack 10 comprises a single length of wire formed to provide spaced elongated arms 33 and 34 on each end thereof joined by a holder portion 29 at the upper end thereof. Likewise, side support 15 comprises a single length of wire formed to provide elongated arms 37 and 38 joined by a holder portion 30 at the upper end thereof.

On side support 14, the upper ends of the elongated arms 33 and 34 are first bent inwardly and then outwardly and upwardly to form shoulders 39 on either side of the holder portion 29 and the lower ends of the elongated arms 33 and 34 are formed with hooks 31 and 32, respectively, that are attached to the transverse portion 20 of the base 11.

Similarly, on side support 15, the upper ends of the elongated arms 37 and 38 are first bent inwardly and then outwardly and upwardly to form shoulders 40 on either side of the holder portion 30 and the lower ends of the arms 37 and 38 are formed with hooks 35 and 36, respectively, that are attached to the transverse portion 21 of the base 11.

The elongated arms 33 and 34 of the side support 14 are formed so that the hooks 31 and 32 on the respective ends thereof normally reside on the transverse portion 20 within the U-shaped notches 27 and 28 on the opposite side corners of the base 11. Likewise, the elongated arms 37 and 38 of the side support 15 are formed so that the hooks 35 and 36 on the respective ends thereof normally reside on the transverse portion 21 within the U-shaped notches 46 and 47 on the opposite side corners of the base 11.

Referring back to FIG. 1, it should be noted that the longitudinal arms on each side support are closer together at the top than the bottom thereof. This enables one of the side supports, such as side support 15, to be swung down to lie in a collapsed condition substantially in the plane of the base 11, which is lying in an upside down position, with the upper end portions of the elongated arms 37 and 38 thereof residing between the hooks 31 and 32 on the lower end of the elongated arms 33 and 34 of the other side support 14. The other side support 14 can then be swung down so as to lie in a collapsed condition substantially in the plane of the base 11.

As shown in FIG. 4, to open up or erect the rack, both the side supports 14 and 15 are swung upwardly from their collapsed position in FIG. 1. Then, by flexing the elongated arms 37 and 38 of one of the side supports 15 inwardly toward each other by applying a modest force, as indicated by arrows 38, the hooks 35 and 36 on the ends of the elongated arms are caused to slide inwardly on the transverse portion 21 and out of the U-shaped notches 46 and 47 at the side corners of the base. This frees the side support 15 so that it can be pivoted downwardly on its hooks 35 and 36, as illustrated by arrow 41 in FIG. 4. When the elongated arms 37 and 38 are released, as a result of the elastic restoring forces set up therein, the hooks 35 and 36 slide outwardly on the transverse portion 21 back into their original position within the U-shaped notches 46 and 47 at the opposite side corners of the base.

The side support 14 can be similarly manipulated such that when its elongated arms 33 and 34 are pivoted downwardly and released, as a result of the elastic restoring forces set up therein, the hooks 31 and 32 on the lower ends thereof slide outwardly on the transverse portion 20 into their original position within the U-shaped notches 27 and 28 at the opposite side corners of the base.

Figure 6:
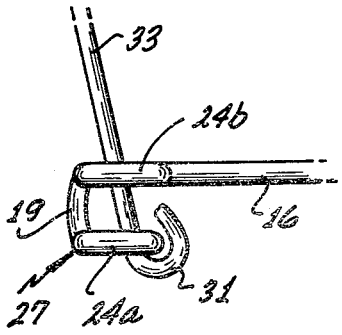
FIG. 6 is an enlarged partial view taken on line 6—6 of FIG. 5 showing one of the elongated arms of a side support effectively locked in the U-shaped notch provided at a side corner of the base.
Figure 5:
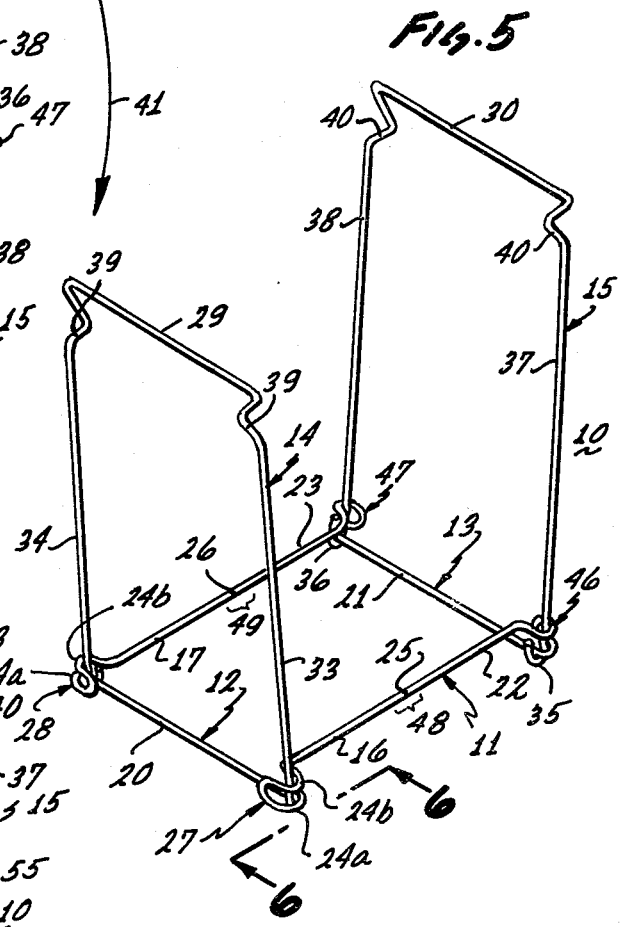
FIG. 5 shows the rack with its base in a rightside up position and with its side supports having a slightly divergent relationship with respect to each other.

After the side supports 14 and 15 have been manipulated as illustrated in FIG. 4, so that they both extend downwardly from the transverse portions of the base 11, the base can now be turned over with the elongated arms 33, 34 and 37, 38 of the side supports 14 and 15 extending generally upwardly and effectively locked in the U-shaped notches 27, 28 and 46, 47, respectively, so that the side supports 14 and 15 have a slightly divergent relationship with respect to each other, as illustrated in FIGS. 5 and 6.

Figure 7:
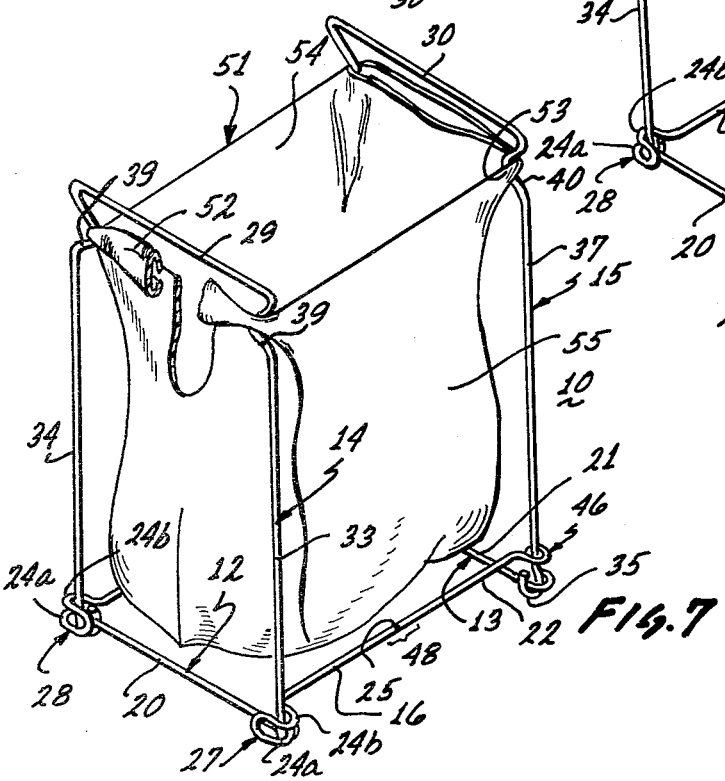
FIG. 7 shows the erected rack being employed to hold a plastic bag in a suspended position with the mouth thereof held open.

As shown in FIG. 7, a typical plastic bag 51, which has previously been used to bring groceries home from a grocery store, can now be placed with its arm holes 52 and 53 respectively fitted over the holder portions 29 and 30 and against the shoulders 39 and 40 formed on the top of each side support 14 and 15. To do this, the diverging side supports 14 and 15 must first be flexed inwardly toward each other by applying a modest force to them. Thus, when the side supports 14 and 15 are released, the plastic bag 51 is held with the sides of the opening on its upper end held taut by the restoring forces set up in the side supports to form a rectangular shaped mouth 54 with the body 55 of the bag 51 suspended therebelow between the side supports 14 and 15, thus enabling trash or the like to be placed therein.

When it is desired to dispose of the plastic bag 51 after it has been filled with trash, the arm holes 52 and 53 on the upper sides of the plastic bag 51 need merely be removed, i.e., slipped off the holder portions 29 and 30 on the upper ends of the side supports 14 and 15 of the rack 10. Another plastic bag 51 can then be positioned with its arm holes 52 and 53 positioned on the handle portions 29 and 30.

It should now be clearly understood that when the base 11 is upside down with the transverse portions 20 and 21 thereof, on which the elongated arms of the side supports 14 and 15 are pivoted, located in an elevated position with respect to a horizontal surface, as shown in FIGS. 1 and 4, the elongated arms of the respective side supports 14 and 15 can be swung down into and out of the plane of the base without interference of the bottom U-shaped wire portions of the corner notches, such as the U-shaped wire portions 24*b*, at the side corners of the base 11.

On the other hand, when the base 11 is rightside up, with the transverse portions 20 and 21 thereof, on which the elongated arms of the side supports 14 and 15 are pivoted, located adjacent a horizontal surface on which the base lies, as shown in FIGS. 5 and 6, the elevated U-shaped wire portions of the notches, such as the U-shaped wire portions 24*a*, at the side corners of the base, effectively lock the elongated arms of the side supports in a substantially upright position.

It should now be clearly understood that one of the advantages of the rack of the present invention is that the U-shaped notch at each of the corners of the base is simply integrally formed from a position of the same unitary length of wire used to form the half longitudinal portions and the transverse portion of a base half. Such a forming of the corner notches from a unitary length of wire assures that no protruding sharp ends of the wires are present at the four corners of the base which could cause damage to the surface of any other article it may touch during the use or handling of the rack.

While the description has been concerned with a particular structural embodiment of the present invention, it is to be understood that many modifications and variations in the construction and arrangement thereof may be provided for without departing from the spirit and scope of the invention or sacrificing any of its advantages and the invention is, therefore, considered to be limited only as indicated by the scope of the appended claims.

What is claimed is:

1. A rack for a plastic bag comprising:

a rectangular base formed of wire to include transverse portions and longitudinal portions and a notch at each of its corners, each said notch formed of a pair of vertically spaced U-shaped wire portions with one of the U-shaped wire portions being formed as a continuation of the transverse portion and the other wire portion being formed as a continuation of the longitudinal portion of the base;

a pair of side supports, each side support formed of wire to include a pair of spaced elongated arms with holder portions joining the upper ends thereof and with hooks on the lower ends thereof by which each side support is held on a transverse portion of said base;

each side support capable of being swung on the respective transverse portion of said base to a position substantially in the plane of the base when said base is positioned with the U-shaped wire portion forming continuations of the transverse portions located above the U-shaped wire portions forming continuations of the longitudinal portions; and each side support capable of having its elongated arms effectively locked in a substantially upright position by the U-shaped wire portions forming continuations of the longitudinal portions when said base is positioned with the U-shaped wire portions forming continuations of said transverse portions located below the U-shaped wire forming continuations of the longitudinal portions of the base;

whereby when said side supports have their elongated arms effectively locked in a substantially upright position a plastic bag having arm holes on each upper side thereof can be suspended with its arm holes on the holder portions of said side supports and the mouth of the bag in an open position.

2. A rack for a plastic bag as defined in claim 1 wherein said holder portions joining the upper ends of the spaced elongated arms of said side supports are formed with shoulders.

3. A rack for a plastic bag as defined in claim 1 wherein said base is formed with two lengths of wire to provide two identical halves, each said half having straight end portions joined together to form the longitudinal portions of said base.

4. A rack for a plastic bag as defined in claim 1 wherein each said side support had its elongated arms effectively locked by the U-shaped wire portions forming continuations of the longitudinal portions such that the side supports have a diverging relationship with each other.

5. A rack for a plastic bag as defined in claim 1 wherein the pair of spaced elongated arms on each said side support is closer together at the top end than the hooked ends thereof.

6. A rack for a plastic bag as defined in claim 1 wherein the hooked ends of the spaced elongated arms on each said side support normally reside on a transverse portion of said base within the notches at the corners of the base.

7. A rack for a plastic bag as defined in claim 1 wherein the spaced elongated arms on each said side supports are sufficiently flexible so that they can be manually flexed inwardly toward each other to free the hooks on the ends thereof from their normal position in the notches at the corners of the base.

8. A rack for a plastic bag as defined in claim 1 wherein the elongated arms of the side supports are sufficiently flexible and formed so that when a modest force is applied to move the hooks on the ends thereof inwardly on the transverse portions out of the notches at the corners of the base, an elastic restoring force is set up therein so that when the arms are released the hooks return back to their original position on the transverse portion within the notches at the corners of the base.

* * * * *